United States Patent [19]

Nambu et al.

[11] Patent Number: 4,788,989

[45] Date of Patent: Dec. 6, 1988

[54] PROCESS FOR THE TEMPERATURE CONTROL OF A DRYING APPARATUS FOR TOBACCO LEAVES

[75] Inventors: Yutaka Nambu; Hitosi Sugawara; Yasuo Saitoh, all of Hiratsuka, Japan

[73] Assignee: Japan Tobacco, Inc., Tokyo, Japan

[21] Appl. No.: 28,941

[22] Filed: Mar. 23, 1987

Related U.S. Application Data

[63] Continuation-in-part of Ser. No. 742,858, Jun. 10, 1985, abandoned.

[30] Foreign Application Priority Data

Jun. 21, 1984 [JP] Japan ..... 59-126406

[51] Int. Cl.[4] ..... A24B 3/10; A24B 3/12

[52] U.S. Cl. ..... 131/303; 131/305

[58] Field of Search ..... 131/305, 303; 34/28, 34/46, 48, 52

[56] References Cited

U.S. PATENT DOCUMENTS 4,170,073 10/1979 Ignatowicz ..... 131/303
4,194,515 3/1980 Graalmann et al. ..... 313/303
4,336,660 6/1982 Strydom ..... 131/303

*Primary Examiner*—Vincent Millin
*Assistant Examiner*—Joe H. Cheng
*Attorney, Agent, or Firm*—Armstrong, Nikaido, Marmelstein & Kubovcik

[57] ABSTRACT

A temperature control method of a cut tobacco leaves drying apparatus having a rotary hollow cylinder around which a plurality of heaters are mounted and in which the cut tobacco leaves are dried while they are carried along the rotational axis of the cylinder toward the exit of the cylinder during the rotation of the cylinder.

The method is capable of bringing moisture rate of the cut tobacco leaves to a desired value as fast as possible when they are dried for a period of time shortly after the cut tobacco leaves begin to flow into the drying apparatus.

The heaters mounted on the cylinder are supplied heat with the amount of heat medium controlled independently of each other. Therefore the inner space of the cylinder defines cascaded drying-spaces of which the temperatures are controlled in response to a fow rate of the cut tobacco leaves flowing through the drying-spaces.

1 Claim, 6 Drawing Sheets

PROCESS FOR THE TEMPERATURE CONTROL OF A DRYING APPARATUS FOR TOBACCO LEAVES

CROSS-REFERENCE TO RELATED APPLICATIONS

This application is a continuation-in-part of Ser. No. 742,858, filed June 10, 1985 now abandoned.

BACKGROUND OF THE INVENTION

The present invention relates to a process for temperature control, and in particular to a process for the temperature control of a drying apparatus in which cut tobacco leaves charged into the entrance thereof are dried to a required moisture rate and from which the cut tobacco leaves are then discharged.

In drying cut tobacco leaves, manufacturers make every effort in order to obtain final tobacco products with a consistent required moisture rate. There are two consecutive periods of time in a drying process for cut tobacco leaves. One is the period of time shortly after cut tobacco leaves begin to be charged into the drying apparatus and this is called the rise-up time or unsteady period during which the flow rate of the cut tobacco leaves at the exit of the drying apparatus has not yet reached its steady value. The other time period is the period of time subsequent to the unsteady period and is called the stable time or the steady period during which the flow rate of the cut tobacco leaves at the exit of the drying apparatus has reached its steady value.

If the cut tobacco leaves are dried in the same manner throughout these two drying-periods, the cut tobacco leaves are over-dried in the unsteady period because of excess heat for the flow rate of the cut tobacco leaves in that period and it is impossible to obtain cut tobacco leaves having the desired moisture rate during the unsteady period.

For example, if the unsteady period of a drying apparatus is 10 to 15 minutes and the flow rate of the tobacco leaves is 6000 kg/h, then, it is easy to obtain an unqualified production of 50 to 100 kg.

Furthermore, recent customers' requirements for tobacco taste are high and it is required to provide not only just-qualified products but also products with high-quality.

SUMMARY OF THE INVENTION

The present invention provides a solution to the problem of the prior art mentioned above. It is an object of the present invention to provide a process for controlling the temperature of a cut tobacco leaves drying apparatus, which is capable of bringing the moisture of dried cut tobacco leaves during the aforementioned unsteady period to a desired value as fast as possible and of providing cut tobacco leaves having excellent quality.

DETAILED DESCRIPTION OF THE PREFERRED EMBODIMENT

The present invention will be described by way of embodiments with reference to the drawings.

Figure 1:
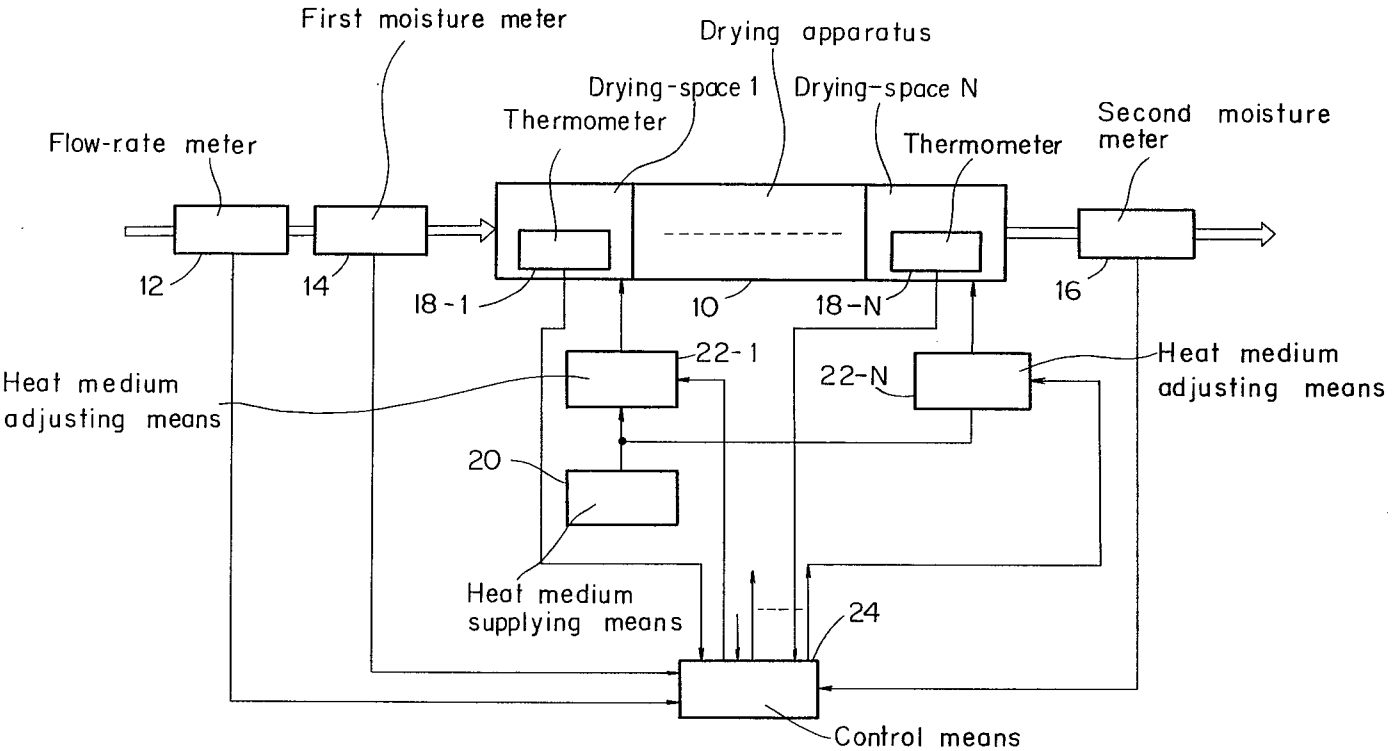
FIG. 1 is a schematic block diagram showing a drying apparatus for carrying out a process of the present invention.

Referring to FIG. 1, there is shown a schematic structure of the system for accomplishing a process of the present invention.

Reference numeral 10 is a drying apparatus comprising a rotary hollow cylinder and the cut tobacco leaves to be dried are carried through the cylinder along the rotational axis of the above mentioned rotary cylinder.

A plurality of heater means (not diagrammatically shown) are disposed around the outer wall of the cylinder along the direction of movement of the cut tobacco leaves and each heater-means heats, independently of each other, the portion about which it is mounted.

Reference 12 represents a flow rate meter for measuring the amount of cut tobacco leaves per unit time, and 14, a first moisture meter for measuring the moisture rate of the cut tobacco leaves before drying. Reference 16 represents a second moisture meter.

The flow rate member 12 and the first moisture meter 14 are disposed outside the entrance of the drying apparatus 10.

The second moisture meter 16 is disposed outside the exit of the drying apparatus for measuring the moisture rate of the cut tobacco leaves after drying.

Thermometers 18-1 to 18-N are provided in the first to Nth drying-space for determining the temperature therein. Reference numeral 20 represents a heat medium supply means for supplying heat medium. And the heat medium. And the heat medium is supplied to the heater means of each drying-space for heating each space to a required temperature.

The heat medium is in the form of steam in this embodiment and therefore the heater means are pipes.

Heat medium adjusting means 22-1 to 22-N which are disposed between the heat medium supply means 20 and the heater pipes in each drying space, respectively, are adapted to adjust the supply of the heat medium to each heater pipe in the first to the Nth drying spaces from the heat medium supply means 20, thereby adjusting the temperature of each drying-space, under the control of the control means 24 which will be described later. The amount of heat medium is adjusted by opening or closing diaphragm valves of the heat medium adjusting means.

The rotary hollow cylinder which forms the drying apparatus is tilted so that the entrance is slightly higher than the rest, when the rotary cylinder is driven to rotate, the cut tobacco leaves charged into the entrance thereof move toward the exit and are discharged from the exit after they are dried to the required moisture rate.

Figure 2:
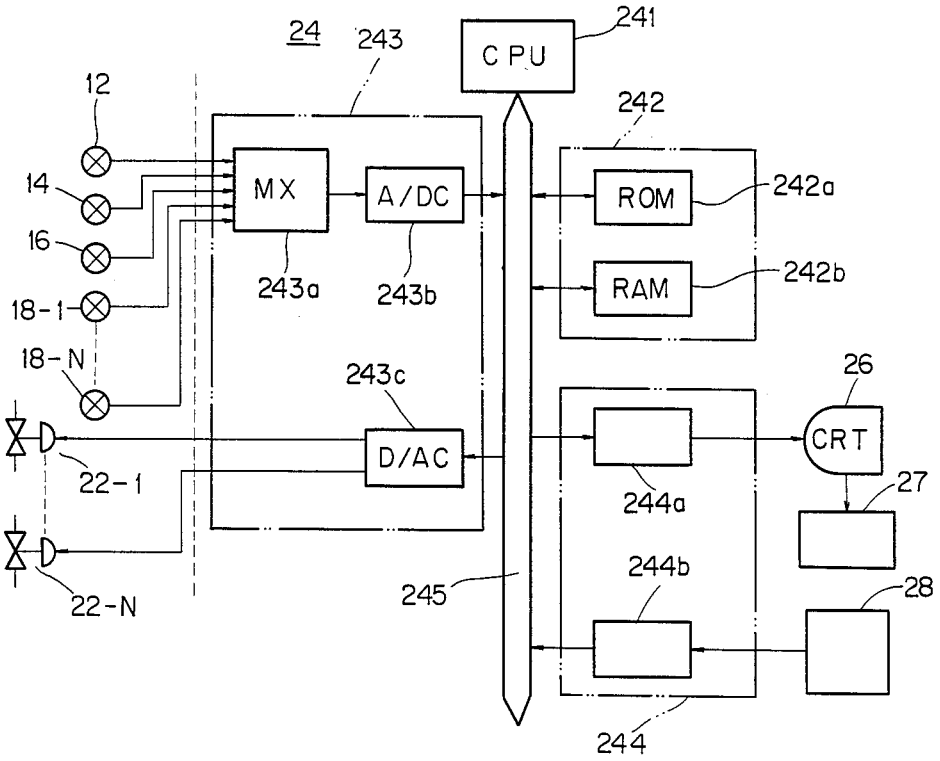
FIG. 2 is a block diagram showing an embodiment of the control means shown in FIG. 1.

FIG. 2 shows a control means 24 for a drying apparatus that is controlled by the temperature-control process according to the present invention. Numeral 243 is an I/O port placed between the control means 24 and a group of measuring instruments that are disposed at respective parts of the drying apparatus. This group of measuring instruments includes the flow rate meter 12, the first moisture meter 14, the second moisture meter 16 and the thermometers 18-1 to 18-N.

A multiplexer **243*a* receives analog input signals from the group of measuring instruments by selecting the signals sequentially from one instrument to another according to the instruction from a central processing unit 241 (referred to as CPU hereafter). And the multiplexer 243*a* outputs the signals received to a subsequent analog-to-digital converter 243*b*** (referred to as A/D converter hereafter).

A/D converter **243*b* converts the analog input signals to digital signals and transfers them to CPU 241 via a data bus 245**.

Numeral 242 is a memory device which comprises a read only memory **242*a* (referred to as ROM hereafter) storing the temperature control program for the drying apparatus according to the present invention and a random access memory 242*b* (referred to as RAM) storing the constants ($\alpha$, $\beta$, $\gamma$, etc.) necessary for executing the temperature control program, the flow rate (Fo) and the moisture rate ($\omega$1, $\omega$2**) of cut tobacco leaves before and after drying, results (Tao, Tseti, Mfi, Mbi etc.) of arithmetic operation and so on.

The CPU 241 performs the arithmetic operation on the basis of the data fromm A/D converter 243B in accordance with the temperature control program stored in the ROM **242*a*. The CPU 241 outputs signals (Mfi, Mbi, etc.) specifying the adjustment of the diaphragm valve of the heat medium adjusting means 22-1 to 22-N to a digital-to-analog converter 243*c* (referred to as D/A converter hereafter) via the data bus 245. The D/A converter 243*c* converts the digital signals from the CPU 241 to the analog signals and outputs the analog signals representative of adjustments of the diaphragm of the heat medium adjusting means 22-1 to 22-N**.

The heat medium adjusting means 22-1 to 22-N adjust the valve of their built-in diaphragm thereby adjusting the amount of heat (amount of steam) supplied to the heater pipes of respective drying spaces.

The numeral 244 is an I/O device for operating the control means 24.

The numeral 26 is a CRT display and its displays numerical values and other data for the control on its screen when these data are input through a key board 28 by an operator. The numeral **244*a* is a serial interface and it receives the data from CPU 241 through the data bus 245 when the control state of the drying apparatus is to be printed out by a printer 27. The numeral 244*b* is an interface means between the key board 28 and the CPU 241**.

The detailed description of the embodiment of the temperature control by the control means 24 mentioned above is given with reference to FIG. 3 to FIG. 11.

Figure 3:
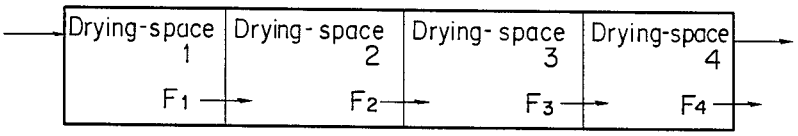
FIG. 3 is a schematic diagram illustrating an example of the drying apparatus.
Figure 4:
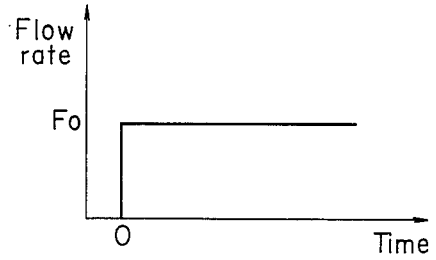
FIG. 4 shows a curve of the change in flow rate of the cut tobacco leaves charged into the drying apparatus shown in FIG. 3.
Figure 5:
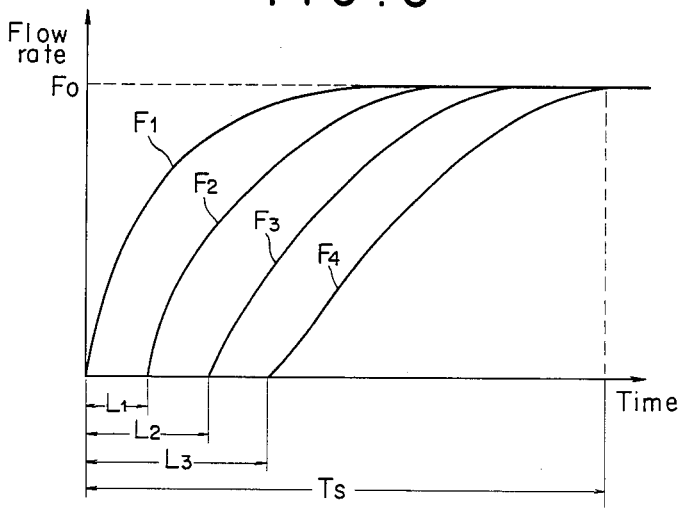
FIG. 5 shows curves of the change in flow rate at the end of each drying-space when the cut tobacco leaves charged at a flow rate shown in FIG. 4.

In a drying apparatus 10 in which a first to a fourth drying-space are defined as shown in FIG. 3, if the flow rate of the cut tobacco leaves at the entrance of the drying apparatus 10 rises up to Fo at t=o as shown in FIG. 4, the flow rate characteristics (change in flow rate with time) of F1, F2, F3, and F4 at each drying space are shown in FIG. 5. In FIG. 5, F1, F2, F3, and F4 represent the flow rate at the cross section of the end of a first drying-space, a second drying-space, a third drying space, and a fourth drying-space, respectively. The waiting time L1, L2, and L3, denote the time required for the cut tobacco leaves to travel the distance between the entrance of the drying apparatus and the exit of the 1st drying-space, the distance between the entrance of the drying apparatus and the exit of the 2nd drying-space, the distance between the entrance of the drying apparatus and the exit of the 3rd drying-space.

And Ts represents the time required till the flow rates at respective drying-spaces reach their steady value Fo. The flow rate curves F1, F2, F3, and F4 are approximated by neglecting L1, L2 and L3 as follows:

$$Fi\,(s) = \frac{Fo}{(1 + Tfi \cdot s) \cdot s} \tag{1}$$

where i represents the ith drying-space and Tfi represents time constant of flow rate characteristics at the ith drying-space and s, a Laplacian operator.

Under the condition in which F1 to F4 have reached a constant flow rate Fo after Ts, the temperature Tao at each drying-space for bringing the moisture rate of the dried cut tobacco leaves to a required value is given by following equation.

$$\begin{aligned} Tao &= \alpha \cdot Fo + \beta \cdot \omega 1 - \delta \\ &= \alpha\,(F + \Delta F) + \beta\,(\omega + \Delta\omega) - \delta \\ &= (\alpha \cdot F + \beta \cdot \omega - \delta) + (\alpha \cdot \Delta F + \beta \cdot \Delta\omega) \end{aligned} \tag{2}$$

where $\omega$1 represents moisture rate of cut tobacco leaves before drying and is measured by a first moisture meter 14 shown in FIG. 1. F is a nominal flow rate. And $\omega$ is a nominal moisture rate of the cut tobacco leaves before drying. The Fo fluctuates by $\Delta F$ with respect to the nominal value F, and the $\omega$1 fluctuates by $\Delta\omega$ with respect to the nominal value $\omega$. The $\alpha$ represents a temperature required per unit flow. $\gamma$ is a constant derived from experiments. The $\beta$ represents a temperature required per unit moisture rate before drying. The $\alpha$ and $\beta$ are empirical data proper to specific cut tobacco leaves to be dried and remain constant throughout the drying spaces. Assuming that To is the temperature of respective drying spaces immediately before the cut tobacco leaves begin to flow thereinto, it is possible to properly control the moisture rate of the cut tobacco leaves to a predetermined target value by allowing the temperature of each drying-space to rise up to Tao according to the curves shown in FIG. 6 so that large quantity of over dried cut tobacco leaves are not produced when the drying apparatus starts discharging.

Figure 6:
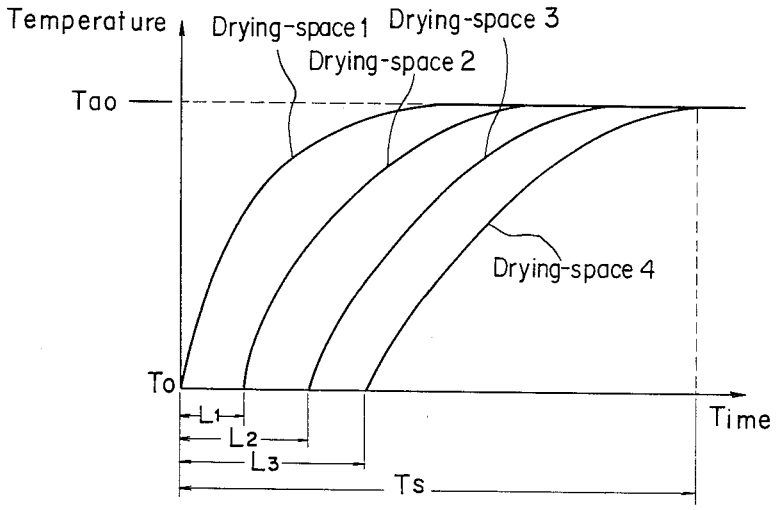
FIG. 6 shows curves of the change in temperature at each drying-space when the flow rate is as shown in FIG. 5.

FIG. 6 is approximated from flow characteristics in FIG. 5.

In the period before the temperature of ith drying space reaches Tao, if we laplace-transform the optimum temperature curve Tai(t) at time t, neglecting the waiting time Li, we obtain the following equation.

$$Tai(s) = \zeta, \{Tai(t) - To\} = \frac{Tao - To}{(1 + Tfi \cdot s) \cdot s} \quad (3)$$

where i denotes the ith drying-space and $\zeta$, a laplace transformation operation.

Now, our experience tells us that providing the temperature with a gradient is more suitable for quality of tobacco than maintaining a same temperature throughout the drying apparatus.

Accordingly, all the temperatures in steady state are not set to Tao but, for example, temperatures Tao+ΔT1, Tao, and Tao−ΔT2 are set to the first through the third drying-space respectively so that the temperature decreases in discrete steps toward the exit. Thus the curves in FIG. 6 will be those in FIG. 7.

Although no specific partitions or the like are incorporated within the cylinder to define the drying-spaces, the temperatures in each heated portion of the cylinder will not be averaged out throughout the cylinder by convection or conduction. Because the temperature of the cut tobacco leaves is much lower than that of the cylinder and the cut tobacco leaves are always moving toward the exit of the cylinder. Above equation (3) can be rewritten as follows.

$$Ta1(s) = \frac{Tao + \Delta T1 - To}{(1 + Tf1 \cdot s) \cdot s} \quad (3')a$$

$$Ta2(s) = \frac{Tao - To}{(1 + Tf2 \cdot s) \cdot s} \quad (3')b$$

$$Ta3(s) = \frac{Tao + \Delta T2 - To}{(1 + Tf3 \cdot s) \cdot s} \quad (3')c$$

$$Ta4(s) = \frac{Tao - To}{(1 + Tf4 \cdot s) \cdot s} \quad (3')d$$

The time constants Tf1, Tf2, Tf3 and Tf4 of the flow rate characteristics mentioned above are determined appropriately, from the results of fundamental experiment, on the basis of Tf4 of flow rate characteristics F4 in FIG. 5. In practice, Tf1, Tf2, and Tf3 are obtained by multiplying Tf4 with a factor. When the moisture rate of cut tobacco leaves during the unsteady period is to be regulated, if To, the temperature of the drying apparatus immediately before the cut tobacco leaves are charged is in wide variety depending on the different time of the day to start the drying, or the environmental conditions, etc., then it is difficult to ensure a good repeatability of the temperature control due to complexity of conditions. And therefore it is important in the present invention to set the temperature To to a predetermined value before starting the drying process and maintain it constant till the process starts.

Figure 7:
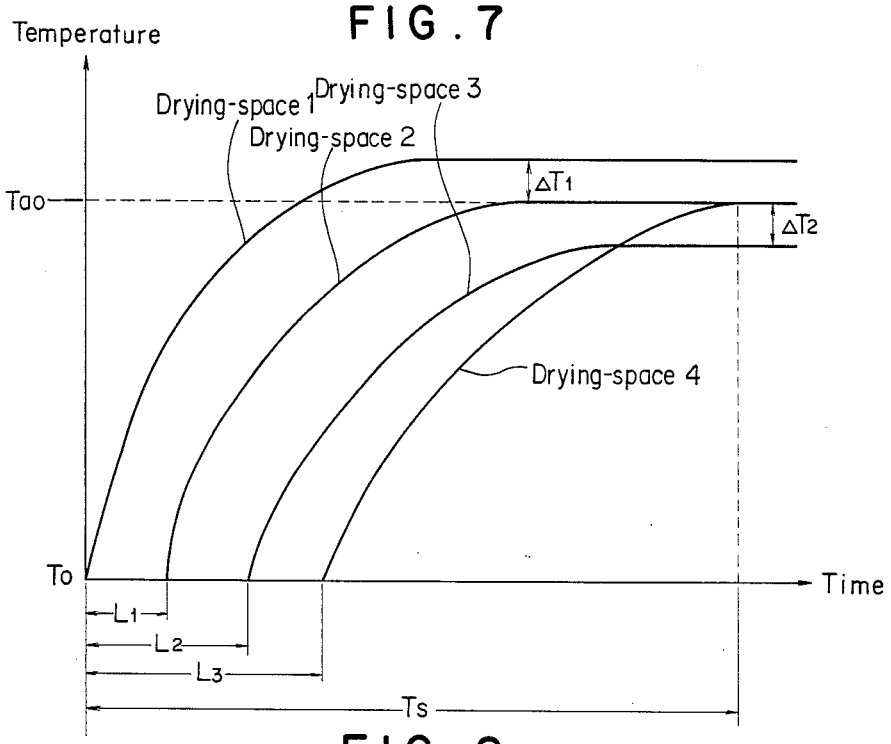
FIG. 7 shows actual temperatures required in each drying-space when the temperatures of each drying-space in the steady period shown in FIG. 6 are given a gradient with which they decrease in discrete steps toward the exit of the hollow cylinder.
Figure 8:
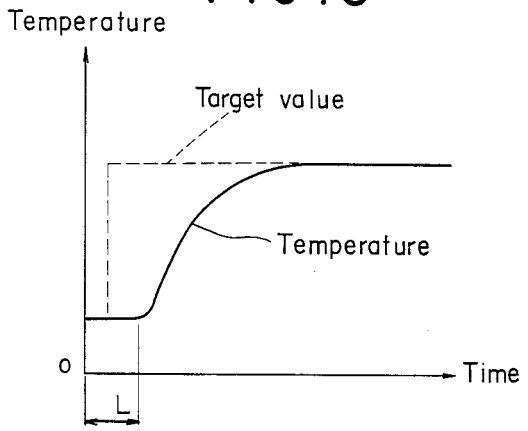
FIG. 8 shows a graph illustrating the heat transfer characteristics of each drying-space.

When the flow rate of cut tobacco leaves is Fo, the optimum temperature curve for each drying-space is shown in FIG. 7.

For example, the temperature of the first drying-space is of an exponential function that starts rising from To at t=o and reaches the final value Tao+ΔT1.

However, these optimum temperature curves are obtained only when the rise in temperature of each drying-space is not accompanied by any time constants. Actually each drying-space has its own heat transfer characteristics that are governed by the structure or materials used.

And therefore even if the temperature of each drying-space reaches the final value shown in FIG. 7 as a result of heat supply at a fixed rate, the curve of the temperature during the temperature-rising period (unsteady period) will be different from the optimum temperature curve in FIG. 7.

In order to obtain the optimum temperature curve in FIG. 7, each drying-space must be heated with its own heat transfer characteristics taken into account.

The temperature of each drying-space that is exponentially rising up at time t will reach its final value, the target temperature, some time later. This target temperature Tset(s) in Laplace transformation is expressed as follows:

$$G(s) = \frac{Ta(s)}{Tset(s)} \quad (4)$$

where G(s) is heat transfer characteristics of each drying-space during the temperature-rising period (unsteady period) and Ta(s) is the required actual temperature of each drying-space at time t during the temperature-rising period.

The heat transfer characteristics of the ith drying-space, Gi(s) in Laplace transformation is given by the following equation.

$$Gi(s) = \frac{1}{1 + Thi \cdot s} \quad (5)$$

The above equation tells us that the heat transfer characteristics of each drying-space is also an exponential function.

Thi denotes the time constant of the heat transfer characteristics of the ith drying-space and the waiting time L is neglected. By manipulating the equations (3) to (5), the target temperature Tseti at time t for obtaining the optimum temperature Tai(t) of the ith drying-space at time t is given by the following equation:

$$Tset1 = Tao + \Delta T1 - \frac{(Tao + \Delta T1 - To)(Tf1 - Th1)}{Tf1} \cdot \exp(-t/Tf1) \quad (8)a$$

$$Tset2 = Tao - \frac{(Tao - To)(Tf2 - Th2)}{Tf2} \cdot \exp(-t/Tf2) \quad (8)b$$

$$Tset3 = Tao + \Delta T2 - \frac{(Tao + \Delta T2 - To)(Tf3 - Th3)}{Tf3} \cdot \exp(-t/Tf3) \quad (8)c$$

$$Tset4 = Tao - \frac{(Tao - To)(Tf4 - Th4)}{Tf4} \cdot \exp(-t/Tf4), \quad (8)d$$

Above equations (8)a to (8)d are obtained by putting equations (3) and (5) into equation (4) for Tset(s) and then transforming Tset(s) back to time domain function.

Equations (8)a to (8)d tell us that if each drying-space is heated at time t for the temperature expressed by Tseti, then the optimum temperature curve shown in FIG. 7 can be established within each drying-space as a result. The value of the target temperatures Tset given by equations (8)a to (8)d increase exponentially with time and their values will converge to the first term of respective equations when the respective drying-spaces go into the steady state.

It should be noted that, in an actual drying apparatus, the change in temperature does not appear immediately after an amount of heat is supplied but some time later. This delay time is denoted by L in FIG. 8. The delay time L suggests that the heat should be supplied the time L earlier than the time at which the temperature is expected to start rising.

Figure 9:
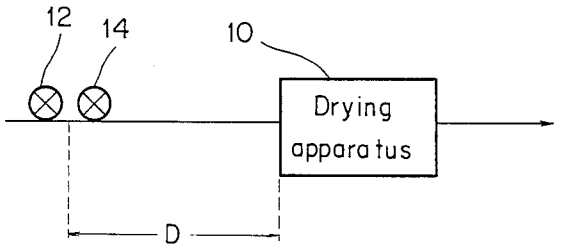
FIG. 9 is an explanatory view showing the positional relation of a flow rate meter and a moisture meter with respect the drying apparatus.

The flow rate meter is installed at a distance D forward to the entrance of the drying apparatus as shown in FIG. 9 and therefore it takes some time for the cut tobacco leaves detected by the flow rate meter 12 to arrive at the entrance of the drying apparatus 10.

Figure 10:
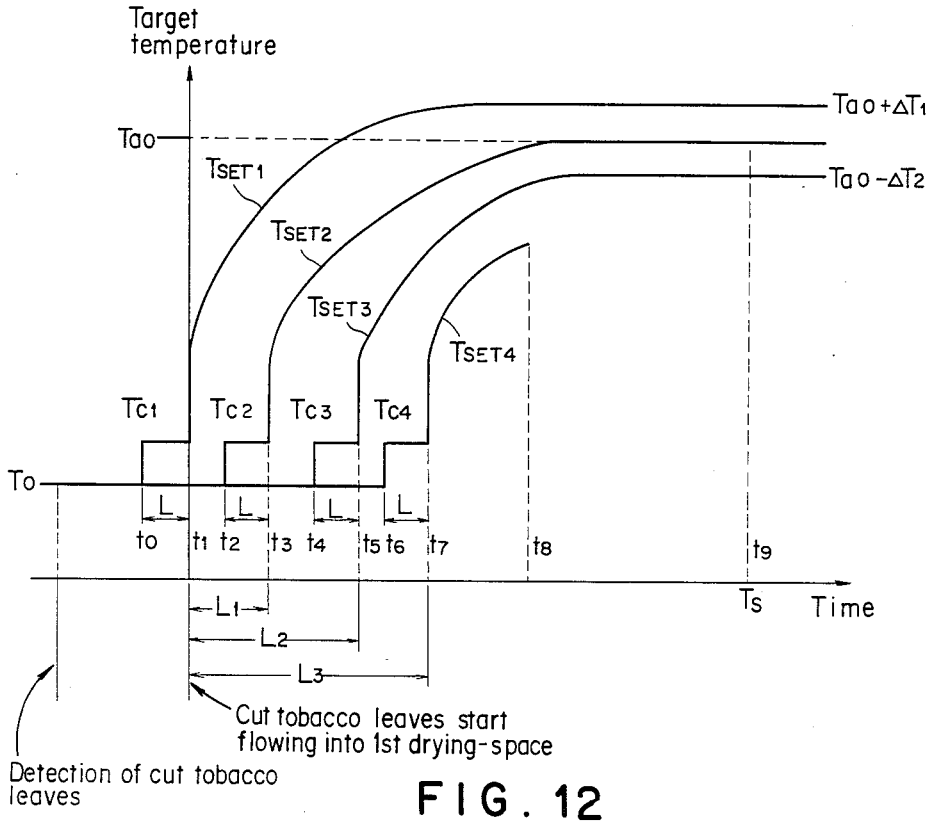
FIG. 10 shows the target temperature at time t so that the actual temperature at time t in each drying-space is as shown in FIG. 7.

Since the required time for the cut tobacco leaves to travel the distance D is known, the first drying-space heated toward Tc1, called a bias temperature in this specification, during t0 to t1 as shown in FIG. 10, taking the delay time L into account so that the actual temperature starts rising up exponentially from T0 to t1. By setting the temperature this way, the optimum temperature curve actually required, as shown in FIG. 7, is obtained. For example, the time at which curve of the first drying-space in FIG. 7 starts rising up is t1 in FIG. 10.

Similarly the second through the fourth drying-spaces are heated toward the bias temperature Tc2, Tc3 and Tc4 during the period t2 to t2, t4 to t5, and t6 to t7 respectively.

After the bias temperature Tci (i denotes the ith drying-space) are set, the target temperature Tset1, Tset2, and Tset3, which are given by equations (8)a to (8)d, are set to the first drying-space through the third drying-space during the the period t1 to Ts, t3 to Ts, and t5 to Ts respectively. The control after Ts is a feed-forward control in which the temperatures Tao+ΔT1, Tao, Tao−ΔT2 are set to each drying-space respectively.

As for the fourth drying-space, the target temperature Tset4 is set according to equation (8)d for the period between t7 and t8, and the drying-space is feed-back controlled after t8, which will be discussed later.

The temperature control described above is of the forecast method in which the target moisture rate of the cut tobacco leaves is obtained by setting the target temperature on the basis of approximated model equations of flow rate characteristics and heat transfer characteristics, etc. And naturally the moisture rate of cut tobacco leaves after drying may be somewhat off the target moisture rate due to errors resulting from approximated equations and other disturbances coming in.

To compensate above errors the moisture rate of the cut tobacco leaves after drying is measured by the second moisture meter 16 at the exit of the drying apparatus at all times and the temperature of the drying apparatus is controlled so that the measured moisture rate $\omega 2$ becomes equal to the target moisture rate $\omega^*$. This method of control is called a feed-back control. Since this feed-back control is carried out by feeding back the actual moisture rate of the cut tobacco leaves after drying simultaneously, the target moisture rate can be ensured.

Though the target temperature Tset1 to Tset4 described above are set, the actual adjustment of the temperature is effected by opening or closing the diaphragm valve of the heat medium adjusting means.

And therefore signal Mfi (a first temperature-adjusting signal) representative of adjustment of the valve is to be obtained through proportional, integral, and derivative operation (PID) as shown in equation (9) below.

i represents the ith drying-space.

$$Mfi = Kpi\left\{(Tseti - Ti) + \frac{1}{TIi}\int (Tseti - Ti)dt + Tdi\frac{d(Tseti - Ti)}{dt}\right\} \quad (9)$$

In equation (9), Kp, TD, and TI represent operation parameters referred to as proportion gain, differentiation time and integration time respectively. Ti is a signal representative of temperatures measured by the thermometers 18-1 to 18-4.

For the period of the feed-back control, the signal Mb5 (a second temperature adjusting signal) for specifying the adjustment of the diaphragm valve of the heat medium adjusting means corresponding to the drying-space 4 is obtained through PID operation given by equation (10) as follows:

$$Mb5 = Kp5\left\{(\omega^* - \omega 2) + \frac{1}{TI5}\int (\omega^* - \omega 2)dt + TD5\frac{d(\omega^* - \omega 2)}{dt}\right\} \quad (10)$$

The valves corresponding to the first drying-space to the fourth drying-space are adjusted by the signal Mfi obtained from equation (9).

The drying-space 4, in addition to the adjustment by Mf4, is adjusted its corresponding value under a cascade control in which Tset4 is set by the signal Mb5 obtained from equation (10). Thus the moisture rate of the cut tobacco leaves during the temperature-rising period can be brought promptly to its target value.

Figure 11:
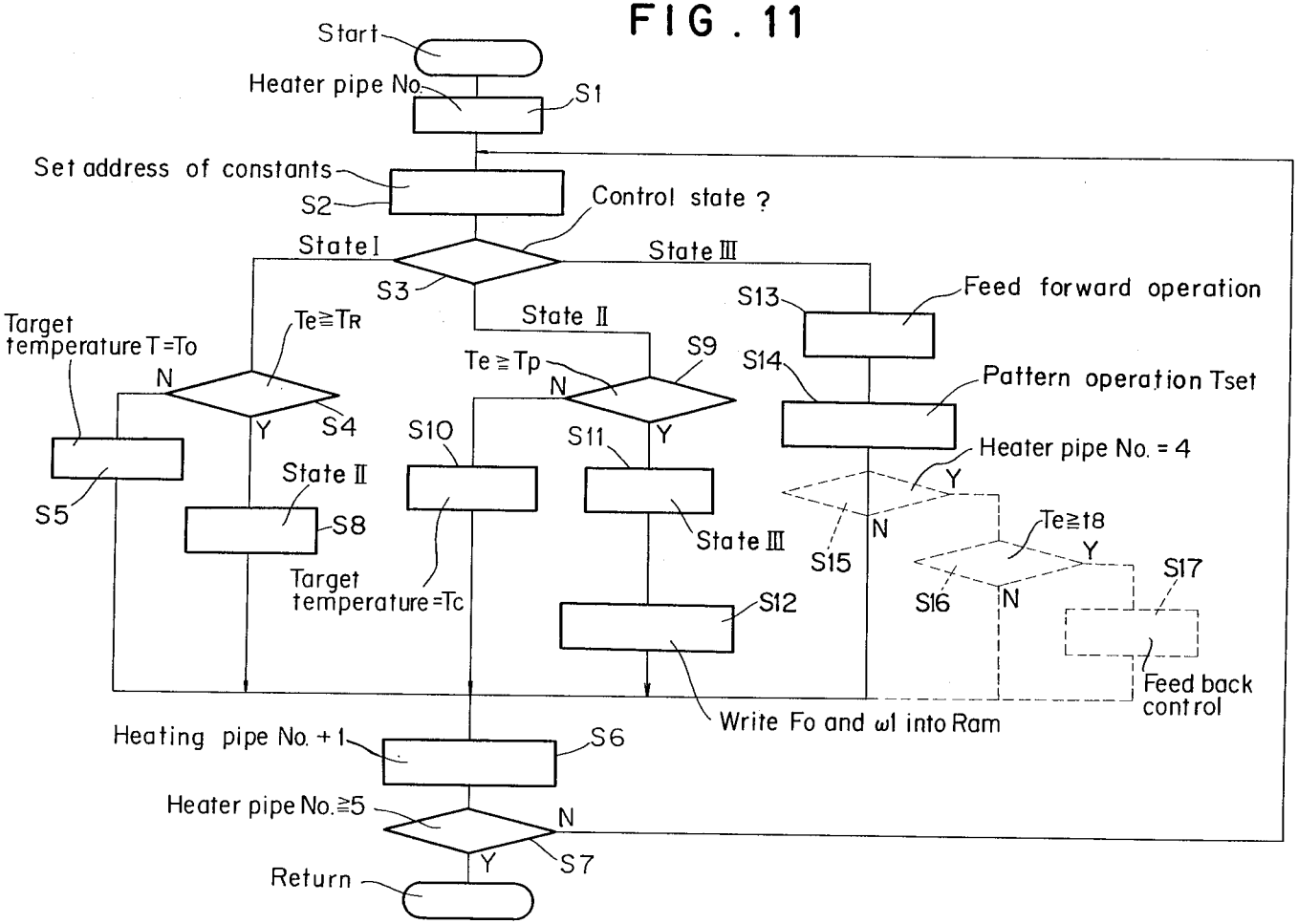
FIG. 11 is a flow chart for carrying out the process of the present invention by means of a computer shown in FIG. 2.

FIG. 11 is a flow chart showing a program for the aforementioned control which the control means 24 executes.

When the program is started in response to the detection of the cut tobacco leaves by the flow rate meter 12, the heater pipe number No. is set to 1 at step S1 to specify the first heater pipe. That is, this setting appoints the control corresponding to the first drying-space. In step S2, data (Tf1, etc.) necessary for controlling the first drying-space is read out from the RAM **242*b* in FIG. 2. The program then proceeds to step 3 in which the program determines what control state the drying apparatus 10** is in.

Figure 12:
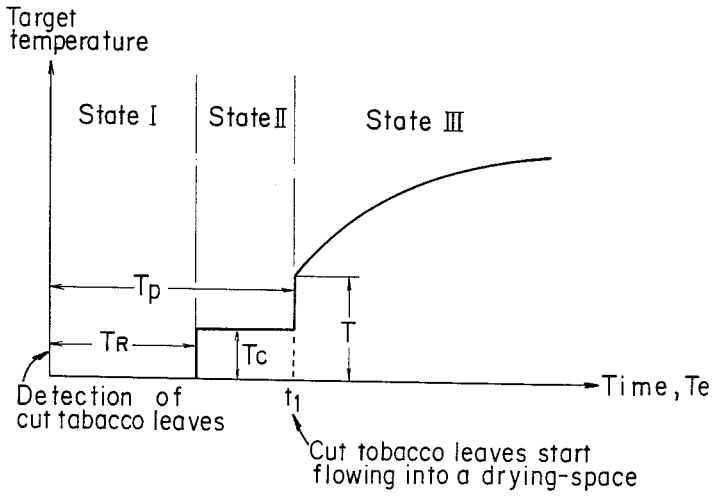
FIG. 12 is a graph for explaining the definition of control states according to the present invention.

The control state defined here is broken down to three consecutive states, namely state I to state III as shown in FIG. 12.

The state I is the period TR between the detection of cut tobacco leaves and setting of the bias temperature Tci. The state II is the period for establishing the bias temperature Tci and is equal to "TP-TR". The state III is the period after the state II is over. Value of the TR depends on the drying-space and is expressed by TRi for the ith drying-space. For example, TR1 is for the first drying-space.

The result in step S3 shortly after the program is started is "state I" and the program proceeds to step S4.

In step S4, the time elapsed Te after the program is started is checked whether or not it is longer than TR. The time Te is represented by the content of the counter which counts "one" per second starting the counting upon detection of the cut tobacco leaves. The program is just started and, of course, Te<TR. The result in step 4 is "NO" (referred to as "N"hereafter) and the program proceeds to step 5.

The target temperature Tset1 is set to To in step 5. The program then proceeds to step 6 in which to the heater pipe number No. is added "1" so that it is now 2. The heater pipe number No. is checked whether or not it is larger than 5 in S7. The result of S7 is "N" and the program returns to step 2.

The data (Tf2, etc.) necessary for controlling the second drying-space is read out from the RAM in step S2. The program proceeds to step S6 through the steps S3, S4, and S5. The heater pipe number No. is altered to 3 in step 6. The program then proceeds to S6 through steps S7, S2, S3, S4, S5.

In step 6, the heater pipe number No. is now set to 4. The program again returns to step 6 through steps S7, S2, S3, S4 and S5. The heater pipe number No. is set to 5 and the program proceeds to step 7.

The result in step 7 is "YES" (referred to as "Y" hereafter) and the program waits for one second then returns to the start. The program proceeds to step S7 through the aforementioned steps S1, S2, S3, S4, S5 and S6. Thereafter the steps S2 through S6 are repeated as described above until the heater pipe number No. is 5. When the heater pipe number becomes 5 the program returns to the start.

Assuming that TR1 for the first heater pipe is 8 seconds, the above-mentioned steps (S1, S2, S3, S4, S5, S6, S7) are repeated 8 times. And when the result in step S4 is Y the program proceeds to step 8. The control state of the first heater pipe is now set to state II. Then the program proceeds to step 6 in which the heater pipe No. is set to 2. Thereafter the program proceeds to step S4 through the steps S7, S2 and S3. Through TR1 for the first heater pipe is 8 seconds the Tri for the second, third and fourth heater pipes are obtained by adding the waiting time L1, L2 and L3 respectively to this 8 seconds (refer to FIG. 7). And therefore the result in step S4 is N. Thereafter the heater pipe number is 5 and steps S4, S5, S6, S7 and S2 are repeated till the program returns to the start. The program is then restarted and the heater pipe number No. is set to 1 in step S1. In step S3, the control is checked what state it is in and the result is state II. The program will proceed to step S9 in which the program checks whether or not the relation Te≧Tp is established. The result is N and the target temperature Tset1 is set to "Tc1" in step S10.

Thereafter the heater pipe number No. is set to 2 in step 6 and the program will repeat steps S6, S7, S2, S3, S4, S5 and S6 again until the heater pipe number is 5. When the result in subsequent step S7 is Y the program returns to the start.

Until the time Te passes Tp, the control through steps S1, S2, S3, S9, S10, S6 and S7 is carried out with the first heater pipe and the control through steps S2, S3, S4, S5, S6 and S7 with the second, the third and the fourth heater pipe.

When the time Te passes Tp of the first heater pipe passes the result in step S9 is Y and the program proceeds to step S11 in which the control state of the first heater pipe is set to state III. Thereafter the program proceeds to step 12 in which data representative of the flow rate Fo and of the moisture rate ω1 of the cut tobacco leaves already measured are written into the RAM.

Then the program proceeds to step S7 through S6. The steps S2, S3, S4, S5, S6 and S7 are repeated with the second, the third, and the fourth heater pipes till the heater pipe number is 5. When the heater pipe number becomes 5 the program returns to the start.

The heater pipe number becomes 5 the program returns to the start.

The heater pipe number No. is set to 1 again in step S1. The program will then proceed to step S3 in which the program is checked what state it is in. The result in step S3 is state III and the program proceeds to step S13 in which Tao is computed on the basis of the data (Fo, ω1, etc.) written into RAM in step S17 and the constants (Tf1, etc.) through computation by equation (2).

The program then proceeds to step S14 in which the pattern operation shown by equation (8)a is performed and Tset1 is set. The target temperature Tset at t=0 in equation (8)a corresponds to T at t=t1 in FIG. 12. The program will proceed to step S7 through S6 after the operation in step S14.

As for the second to the fourth heater pipes, the steps S2 through S7 are executed because these heater pipes are still in state I shortly after the first heater pipe goes into the state III, as apparent from FIG. 10.

Steps S16 and S17 (in dotted line) in FIG. 10 are for performing the feed-back control. In step S15 the heater pipe number No. is checked whether or not it is equal to 4. And in step 16, the program checks whether or not the relation Te≧t8 is established. The t8 is the time when the feed-back control starts. In step S17 the feed-back control is performed.

When the process according to the present invention is carried out in a drying apparatus for cut tobacco leaves with the target moisture rate set to 12.5% wB and the abnormal moisture rate set to 11.5% wB, the total amount of the cut tobacco leaves having an abnormal moisture rate can be as little as 5 kg at a flow rate of the cut tobacco leaves 6000 kg/h.

Although the feed-back control is applied for only the final drying-space in the embodiment above, the equivalent effect can also be obtained by applying the feed-back control for the other drying-spaces together with the final drying-space.

According to the present invention, when the cut tobacco leaves start flowing into the drying apparatus, the temperature of it is controlled not only in response to the flow rate characteristics curves but also compensating the delay time L by the bias temperature, performing the feed-back control, and allowing the temperature gradient with which the temperature of each drying-space decreases in discrete steps toward the exit of the drying apparatus.

What is claimed is:

1. In a cut tobacco leaves drying apparatus having a rotary hollow cylinder around which a plurality of heater means are mounted and in which the cut tobacco leaves are dried while they are carried along the rotational axis of said cylinder toward the exit of said cylinder during the rotation of the cylinder, the process for the temperature control of the drying apparatus comprises the steps of (A)

(a) disposing the heater means along the direction of movement of said cut tobacco leaves, in order beginning with a first heater means at a position closest to the exit of the cylinder, each heater means heating said cylinder at a position around which said each heater means is mounted thereby defining a drying-space in which the cut tobacco leaves are dried while they are carried and the amount of heat medium supplied to each heater means being adjusted individually by a heat medium adjusting means;

(b) mounting, at a place forward to the entrance of said cylinder, a flow rate meter for measuring the flow rate (Fo) of the cut tobacco leaves and a first moisture meter for measuring the moisture rate ($\omega 1$) of the cut tobacco leaves before drying;

(c) mounting a second moisture meter at the exit of said cylinder for measuring the moisture rate ($\omega 2$) of the cut tobacco leaves after they are dried;

(d) mounting a thermometer in each one of said drying-spaces for measuring the temperature therein;

(B) heating said drying-spaces to a first predetermined temperature (To), when operating the drying apparatus, prior to the drying process of the cut tobacco leaves;

(C) defining said process for the temperature control of each one of said drying-space by three consecutive states, state I, state II, and state III;

said state I being a period between the detection of the cut tobacco leaves flowing toward the first drying-space and a start of heating each drying-space to second predetermined temperatures (Tci), said state II being a period between said start of heating each drying-space to said second predetermined temperature and change in temperature in response to it, and said state III being a period during which the cut tobacco leaves are dried in each drying-space;

said state III being further subdivided into two consecutive periods, an unsteady period during which the flow rate of the cut tobacco leaves at the exit of the drying apparatus has not reached its steady value yet, and a steady period during which the flow rate of the tobacco leaves at the exit of the drying apparatus has reached its steady value; and said state II starting in order beginning from the first drying-space followed by succeeding drying-spaces with a predetermined waiting time allowed before subsequent drying-space is started.

(D) heating each one of said drying-spaces toward its corresponding said second predetermined temperatures (Tci) by allowing said heater means to begin heating at the end of said state I;

(E) determining temperatures (Tao) of each one of said drying-spaces in said steady period on the basis of (a) the measured flow rate (Fo) and the moisture rate ($\omega 1$) of the cut tobacco leaves flowing into a first drying-space of said drying-spaces; and (b) a temperature ($\alpha$) required per unit flow rate and a temperature ($\beta$) required per unit moisture rate, both of which being proper to the cut tobacco leaves to be dried; said temperature (Tao) being selected such that said temperature (Tao) decreasesin discrete steps toward the exit of said hollow cylinder;

(F) determining target temperatures (Tseti) of each one of said drying-spaces required at time t in said unsteady period on the basis of (a) said Tao;

(b) the time constant (Tfi) of flow rate characteristics of each one of said drying-spaces; and (c) the time constant (Thi) of heat transfer characteristics of each one of said drying-spaces; said target temperature being a temperature toward which actual temperature (Ti) of each drying-space at said time t will rise;

(G) outputting first temperature-adjusting signals (Mfi) to the corresponding heat medium adjusting means after computing said first temperature-adjusting signals (Mfi) through proportional, integral and derivative (PID) operation on the basis of (a) said target temperatures (Tseti); and (b) said actual temperatures (Ti) of each one of said drying-spaces at said time t measured by said thermometers;

(H) applying, during said state III, a feed-foward control in which the temperature is controlled by adjusting the amount of heat medium supplied to each one of said heater means with said first temperature-adjusting signal (Mfi) corresponding to each one of said drying-spaces;

(I) applying, beginning at a predetermined time (t8) during said unsteady period, a feed-back control in which the temperature is controlled by adjusting the amount of heat medium supplied to said heater means with second temperature-adjusting signals (Mbi) determined through proportional, integral and derivative (PID) operation on the basis of the measured moisture rate ($\omega 2$) of the dried cut tobacco leaves coming out of said cylinder and a predetermined target moisture rate ($\omega^*$); and said feed-back control being applied to at least final drying-space subsequently to said-feed forward control.

* * * * *